US012656090B2

(12) United States Patent
Cohen

(10) Patent No.: US 12,656,090 B2
(45) Date of Patent: Jun. 16, 2026

(54) PROPELLANT CHARGE AND CANNON SHELL THEREWITH

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 0 days.

(21) Appl. No.: 18/283,806

(22) PCT Filed: Mar. 24, 2021

(86) PCT No.: PCT/IL2021/050331
§ 371 (c)(1),
(2) Date: Sep. 24, 2023

(87) PCT Pub. No.: WO2022/201137
PCT Pub. Date: Sep. 29, 2022

(65) Prior Publication Data

US 2024/0167797 A1 May 23, 2024

(51) Int. Cl.

| | |
|---|---|
| ***F42B 5/16*** | (2006.01) |
| ***F42B 1/02*** | (2006.01) |
| ***F42B 1/036*** | (2006.01) |
| *F42B 1/032* | (2006.01) |
| *F42C 19/08* | (2006.01) |
| *F42C 19/09* | (2006.01) |
| *F42C 19/12* | (2006.01) |

(52) U.S. Cl.
CPC ..... *F42B 5/16* (2013.01); *F42B 1/02* (2013.01); *F42B 1/036* (2013.01); *F42B 1/032* (2013.01); *F42C 19/0823* (2013.01); *F42C 19/09* (2013.01); *F42C 19/12* (2013.01)

(58) Field of Classification Search
CPC .. F42B 1/028; F42B 1/032; F42B 5/16; F42B 5/025; F42B 1/02; F42B 1/036; F42B 5/08; F42B 5/26; F42C 19/09; F42C 19/12; F42C 19/0823; F42C 19/0807; F42C 19/083
See application file for complete search history.

(56) References Cited

U.S. PATENT DOCUMENTS

| | | | | |
|---|---|---|---|---|
| 3,097,603 A | | 7/1963 | Harper | |
| 3,726,222 A | * | 4/1973 | White | F42B 5/08 102/431 |

(Continued)

FOREIGN PATENT DOCUMENTS

| | | |
|---|---|---|
| CN | 1668889 | 9/2005 |
| CN | 101078611 | 11/2007 |

(Continued)

OTHER PUBLICATIONS

International Preliminary Report on Patentability Dated Oct. 5, 2023 From the International Bureau of WIPO Re. Application No. PCT/IL2021/050331 (7 Pages).

(Continued)

*Primary Examiner* — James S Bergin

(57) ABSTRACT

A propellant mechanism for launching a projectile comprises a propellant with a detonation point at which said propellant is initially detonated which is at one end in a forward direction closest to said projectile, such that the detonation proceeds through the propellant in a backwards direction away from the projectile. A reflecting surface is provided away from said projectile for reflecting the detonation into the forward direction towards the projectile.

17 Claims, 13 Drawing Sheets

(56) References Cited

U.S. PATENT DOCUMENTS

| | | | | |
|---|---|---|---|---|
| 3,828,676 | A | 8/1974 | Junker | |
| 4,253,523 | A | 3/1981 | Ibsen | |
| 5,421,264 | A | 6/1995 | Petrick | |
| 11,143,493 | B2 * | 10/2021 | Gaide | F42B 5/285 |
| 11,867,491 | B2 * | 1/2024 | Gaide | F42B 5/285 |
| 12,135,197 | B2 * | 11/2024 | Gaide | F42C 19/0834 |
| 12,196,532 | B2 * | 1/2025 | Cohen | F42B 12/24 |
| 2002/0195017 | A1 | 12/2002 | Priimak | |
| 2010/0294156 | A1 | 11/2010 | Berlin et al. | |
| 2013/0200601 | A1 | 8/2013 | Niehaus et al. | |
| 2020/0348114 | A1 | 11/2020 | Feese | |
| 2020/0355474 | A1 | 11/2020 | Underberg, Sr. et al. | |
| 2025/0146800 | A1 * | 5/2025 | Cohen | F42B 12/205 |

FOREIGN PATENT DOCUMENTS

| | | |
|---|---|---|
| CN | 207395576 | 5/2018 |
| DE | 3923461 | 1/1991 |
| GB | 174004 | 1/1922 |
| JP | S57-047789 | 3/1982 |
| JP | 2018-036005 | 3/2018 |
| JP | 2020-533550 | 11/2020 |
| KR | 10-2007-0063487 | 6/2007 |
| WO | WO 2014/018144 | 1/2014 |
| WO | WO 2019/048678 | 3/2019 |
| WO | WO 2019/135762 | 7/2019 |
| WO | WO 2020/058978 | 3/2020 |
| WO | WO 2020/244773 | 12/2020 |
| WO | WO 2022/201137 | 9/2022 |

OTHER PUBLICATIONS

International Search Report and the Written Opinion Dated Jun. 24, 2021 From the International Searching Authority Re. Application No. PCT/IL2021/050331. (11 Pages).

Communication Pursuant to Rule 164 together with Supplementary Partial European Search Report and the European Search Opinion Dated Oct. 23, 2024 From the European Patent Office Re. Application No. 21932826.7. (19 Pages).

Notice of Reasons for Rejection Dated Nov. 5, 2024 From the Japan Patent Office Re. Application No. 2023-558582 and its Translation Into English. (9 Pages).

Supplementary European Search Report and the European Search Opinion Dated Mar. 17, 2025 From the European Patent Office Re. Application No. 21932826.7. (22 Pages).

Notification of Office Action and Search Report Dated Dec. 5, 2025 From the State Intellectual Property Office of the People's Republic of China Re. Application No. 202180097497.1 with its Summary and Machine Translation Into English. (16 Pages).

Relatório de Busca e Parecer [Search Report and Opinion] Dated Nov. 25, 2025 From the Serviço Público Federal, Ministério da Economia, Instituto Nacional da Propriedade Industrial do Brasil Re. Application No. BR 11 2023 019409 1 and Its Translation Into English. (8 Pages).

Grounds of Reason of Rejection Dated Apr. 21, 2026 From the Korean Intellectual Property Office Re. Application No. 10-2023-7036481 and Its Translation Into English. (12 Pages).

* cited by examiner

PROPELLANT CHARGE AND CANNON SHELL THEREWITH

RELATED APPLICATION

This application is a National Phase of PCT Patent Application No. PCT/IL2021/050331 having International filing date of Mar. 24, 2021, the contents of which are incorporated by reference as if fully set forth herein in their entirety.

FIELD AND BACKGROUND OF THE INVENTION

The present invention, in some embodiments thereof, relates to a propellant charge for ejection of projectiles and the like, and also optionally to a cannon shell with such a charge built in.

Currently, propellant efficiency is based on the ability of the propellant to detonate at a specific rate to provide pressure in the chamber to eject the projectile associated with the charge.

The current rate of detonation allows the ejection of projectiles at limited speeds that are well-defined in the art.

Any ability to exceed these limited speeds have proven to be futile and military engineers have moved to the use of the rail gun that uses acceleration via magnetic field aligned along a rail to allow the projectiles to exceed the speeds possible via explosives.

While explosive-based propellants can achieve a muzzle velocity of not more than about 2.3 km/s, railguns are currently able to achieve in excess of 3 km/s, and as much as 3.5 km/s, hence providing the projectile with increased kinetic energy.

SUMMARY OF THE INVENTION

The present embodiments may provide a propellant mechanism that uses one or more shaped charges, to provide a focused explosion. In an alternative aspect, the present embodiments provide detonation that goes in reverse and then is reflected to focus on the projectile.

According to one aspect of the present embodiments there is provided a propellant mechanism for launching a projectile comprising:

- a forward direction and a first end towards said projectile and a backwards direction and a second end away from said projectile;
- a propellant with a detonation point at which said propellant is initially detonated which is at said first end in said forward direction closest to said projectile, such that the detonation proceeds through the propellant in the backwards direction away from said projectile; and
- a reflecting surface at said second end away from said projectile for reflecting said detonation into said forward direction towards said projectile.

According to a second aspect of the present embodiments there is provided a projectile with a propellant mechanism for launching the projectile, the projectile comprising:

- a forward direction and a first end in a launch direction and a backwards direction and a second end away from said launch direction;
- a propellant with a detonation point at which said propellant is initially detonated which is at said first end towards projectile, such that the detonation proceeds through the propellant in the backwards direction away from said projectile; and

- a reflecting surface at said second end away from said projectile for reflecting said detonation into said forward direction towards said projectile.

According to a third aspect of the present invention, there is provided a method of manufacturing a propellant mechanism for launching a projectile, the method comprising:

- Providing high explosive,
- shaping the high explosive into a hemispherical shape having a first rounded surface and a second flat surface;
- shaping hollow inserts into the first rounded surface;
- providing a detonator at said flat surface; and
- placing the shaped high explosive in a casing.

According to a fourth aspect of the present invention there is provided a method of producing a shaped charge comprising:

- defining a desired shape for the charge; and
- building up the shaped charge layer by layer using additive manufacture.

According to a fifth aspect of the present invention there is provided a propellant mechanism and projectile comprising:

- a first end and a second end;
- a propellant with a detonation point at which the propellant is initially detonated, the detonation point being at said first end, such that the detonation proceeds through the propellant towards the second end;
- a reflecting surface at the second end for reflecting said detonation back to said first end;
- a casing, the casing extending from said reflecting surface away from said first end to form a projectile body.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
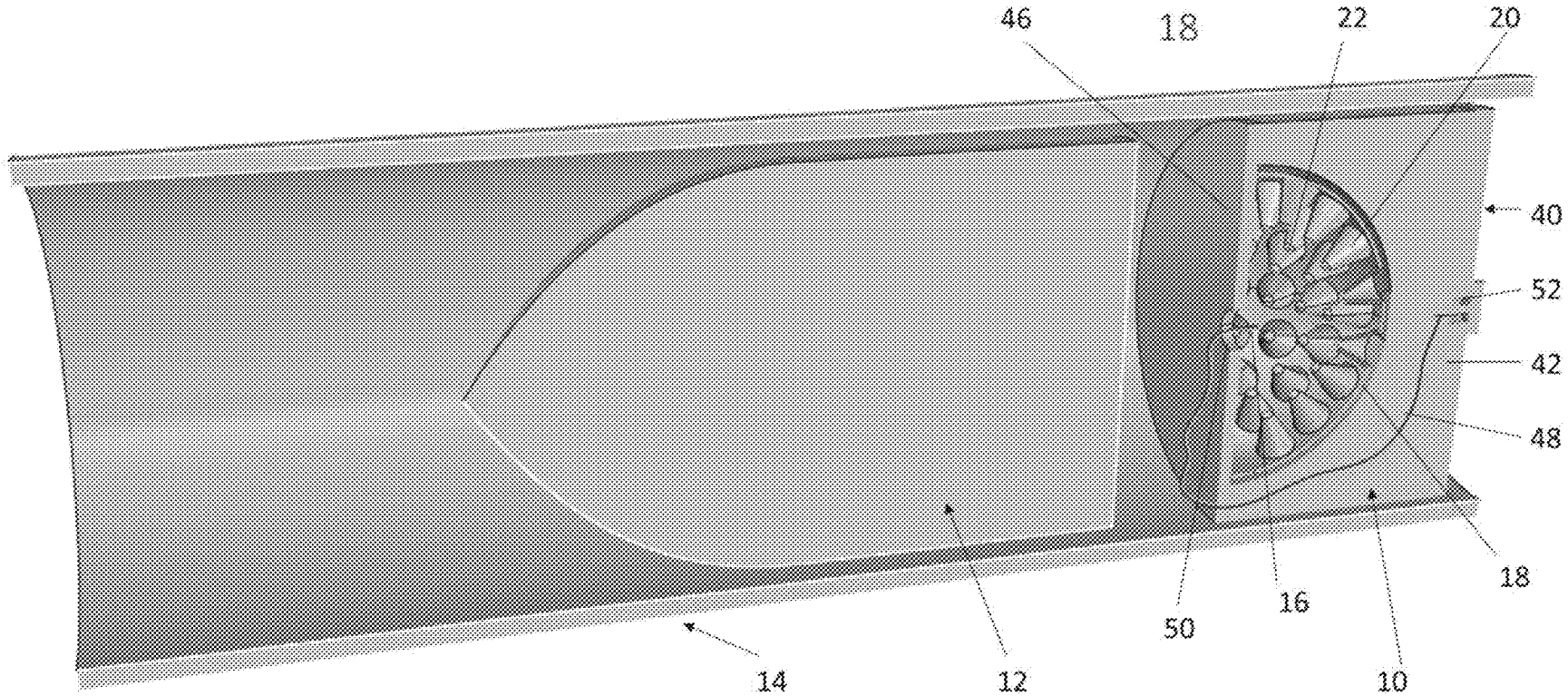
FIG. 1 is a simplified schematic cross-sectional diagram of a shaped propellant according to embodiments of the invention along with a shell in the barrel of a gun.

The present invention, in some embodiments thereof, relates to a propellant charge for ejection of projectiles and the like.

A propellant for a projectile detonates backwards away from the projectile and is then reflected back to the projectile. A predefined geometry of cavities may accelerate the detonation wave. The cavities point towards the source of the detonation. For example, the cavities may be cones, whose longitudinal axes extending through the apexes of the cone meet at the origin of the detonation.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is a simplified cross section of a propellant mechanism 10 and a projectile inside the tube of a gun 14.

The propellant mechanism 10 is detonated to cause a pressure wave in the direction of the projectile to launch the projectile from the tube of a gun or the like.

The propellant mechanism 10 is filled with explosive which is detonated from a detonation point 16. The detonation point is on the side towards the projectile and the propellant is initially detonated from the projectile end. The detonation proceeds through the propellant in the backwards direction away from the projectile 12 until it strikes reflecting surface 18 at the far end away from the projectile. The reflecting surface then reflects the detonation wave back to the forward direction towards the projectile.

The reflecting surface 18 may be shaped to focus the detonation more precisely towards the projectile. In an embodiment the reflecting surface may comprise a predefined geometry of cavities 20. The cavities may in one embodiment point towards the detonation point 16. The cavities may be of any suitable shape and in one example are cones. The cones may each have an apex 22 and a longitudinal axis that extends through the apex. In an embodiment the longitudinal axes of the various cones meet at the detonation point 16.

It is to be noted that the radius, and the overall shape of the hollow and the depth towards the apex are all variables that may be altered to achieve particular levels of power of the pressure wave. Different hollows may be of different shapes or point in different directions, and may produce a propellant of non-uniform profile due to the different shapes of different hollows.

Figure 2:
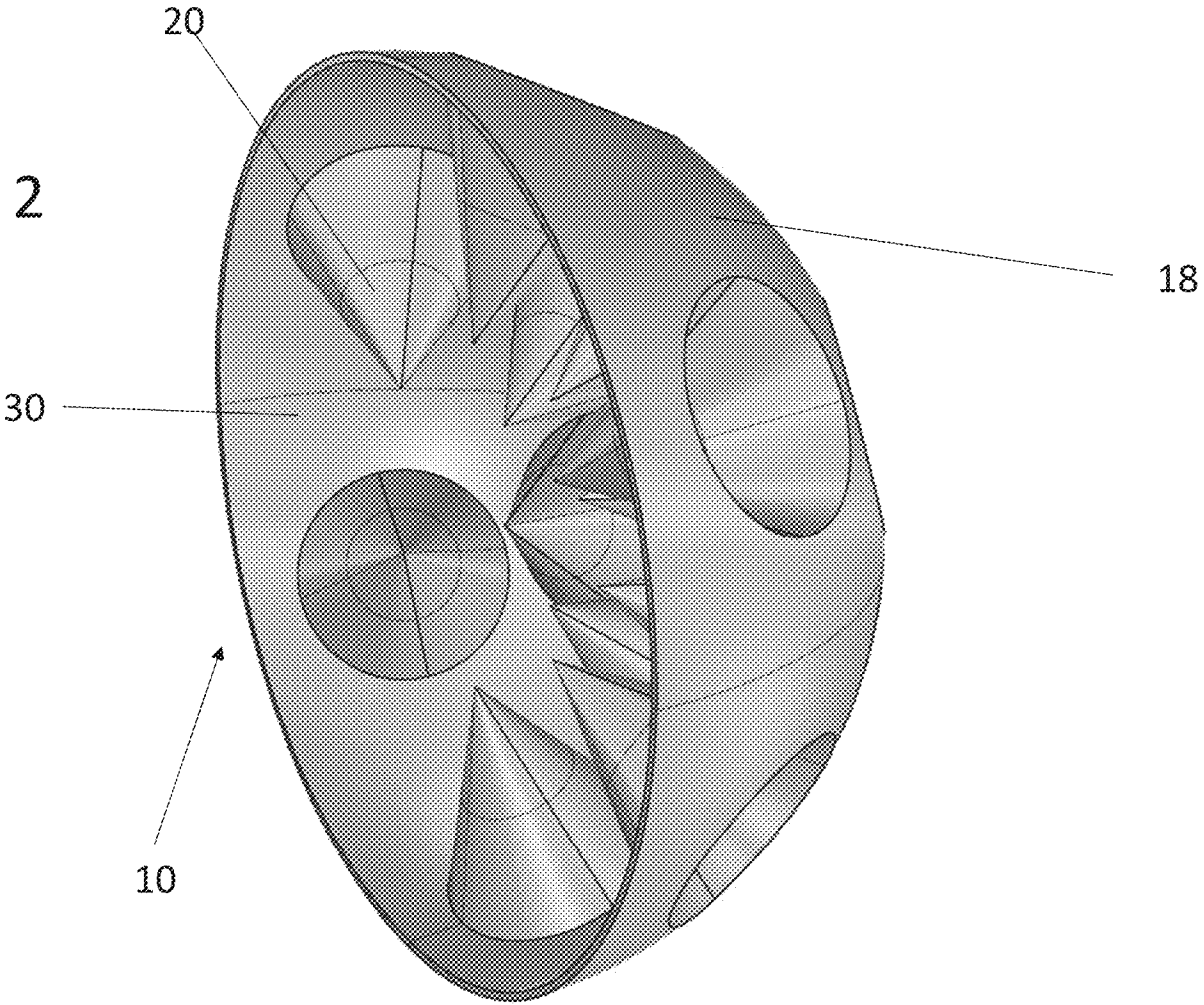
FIG. 2 is a simplified schematic diagram showing in greater detail the shaped propellant of FIG. 1.

Reference is now made to FIG. 2, which shows in greater detail the structure of the propellant mechanism 10 of FIG. 1 according to embodiments of the present invention. As shown in FIG. 2, the reflecting surface 18 may be made up of a parabolic base 30 into which the cavities 20 extend. The hollows may simply be insertions into the body of the high explosive used to make the propellant but in embodiments may be lined with a structural material. Structural material suitable for the present use may include plastics, metal and particularly metal foils and paper and cardboard. In many applications of shaped charges metals are used for the lining in order to provide fragments. However for the purpose of a propellant fragments are not required.

In embodiments, the hollows may be filled with a filler material, which may be any inert material. As mentioned above, a possible shape for the cavities may be cone shapes and in embodiments, the longitudinal axes of the cones through the apexes all point to the initial detonation point.

Upon detonation, a detonation wave extends from the detonation point back into the parabola, from which it is reflected as a focused beam. The result is a reflected and focused push force to eject the projectile from the gun. The hollows may serve to further focus, direct and accelerate the beams. The result of having the beam more focused is a reduction in the amount of energy lost to the sides.

Figure 3:
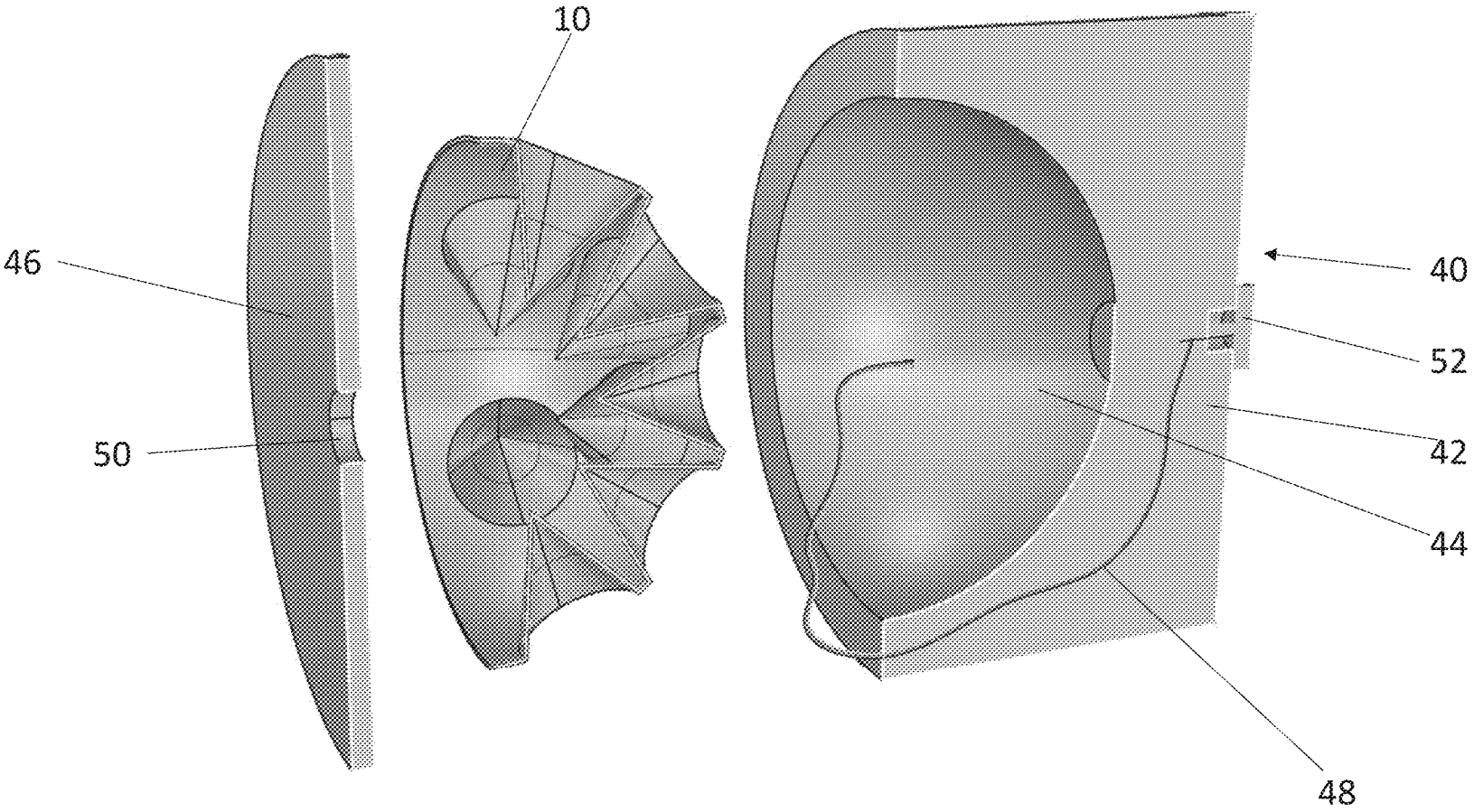
FIG. 3 is an exploded diagram showing the shaped propellant and the casing of FIG. 1 as separate parts.
Figure 4:
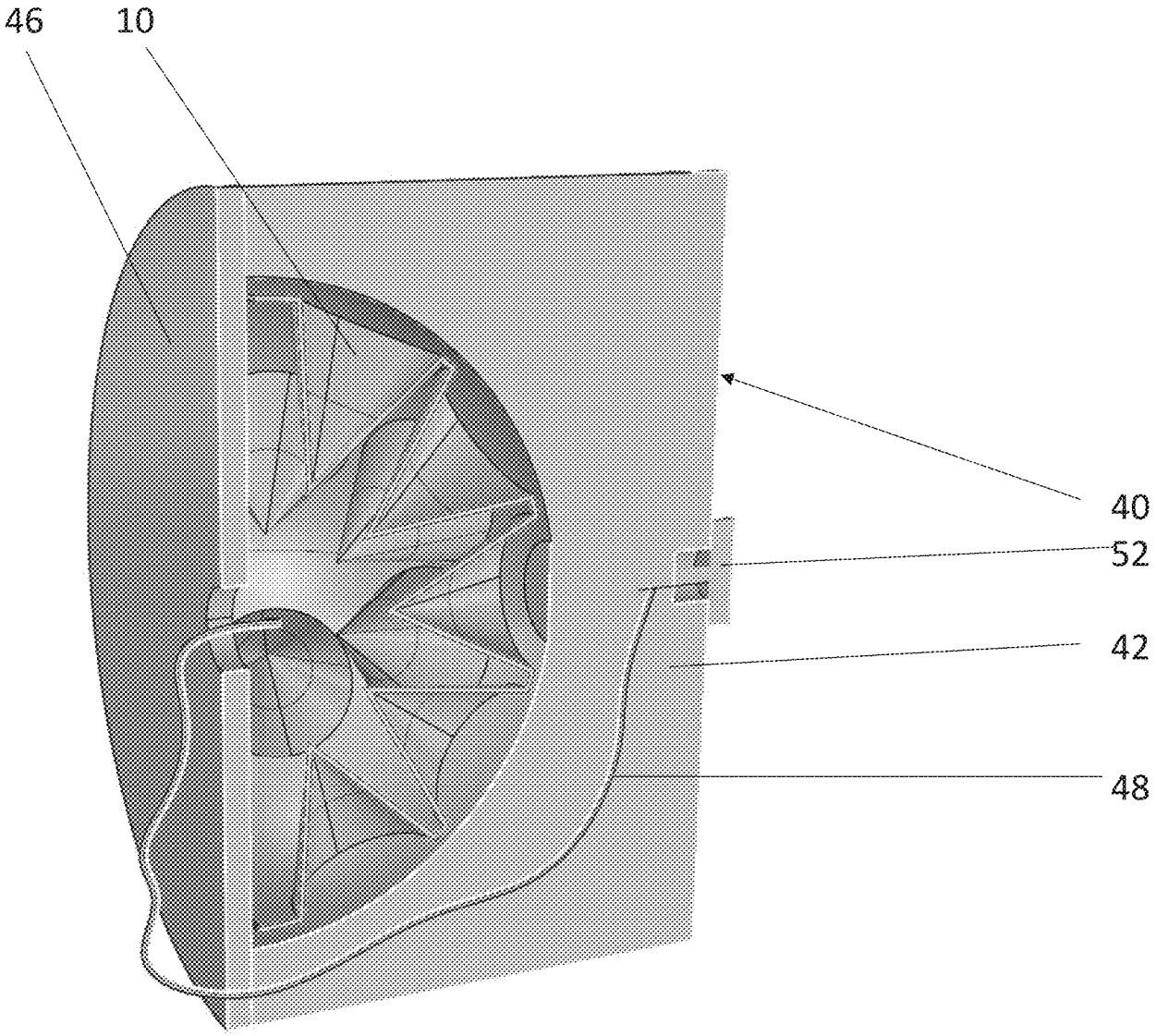
FIG. 4 is a simplified diagram showing the shaped propellant and casing of FIG. 3 fitted together.

Reference is now made to FIGS. 3 and 4, which are two simplified diagrams showing the propellant 10 of FIGS. 1 and 2 with a casing 40. The casing 40 includes a body 42 with a hollow 44 to fit the propellant 10. A plate 46 at the front of the casing, towards the projectile, is optional. In general the front plate may serve to cause pressure to build up until it is strong enough to break the casing and then escape with more dramatic effects. The back of the casing, away from the projectile, may be of sufficient mass to cause preferential pressure discharge in the forward direction. That is to say the pressure is released in the forward direction to launch the projectile, the rear direction experiencing a kickback. As shown in FIG. 3, the casing is detached from the projectile. Thus the propellant and the projectile may be selected separately. Thus propellants of different power may be selected to give different ranges or different penetrating power. A detonation signal is passed by wire 48 through hole 50 in plate 46 to the detonation point at the front of the propellant. The wire receives a trigger signal from the back of the casing at 52.

The full casing 40 with the propellant and the projectile within the gun is shown in FIG. 1.

Figure 5:
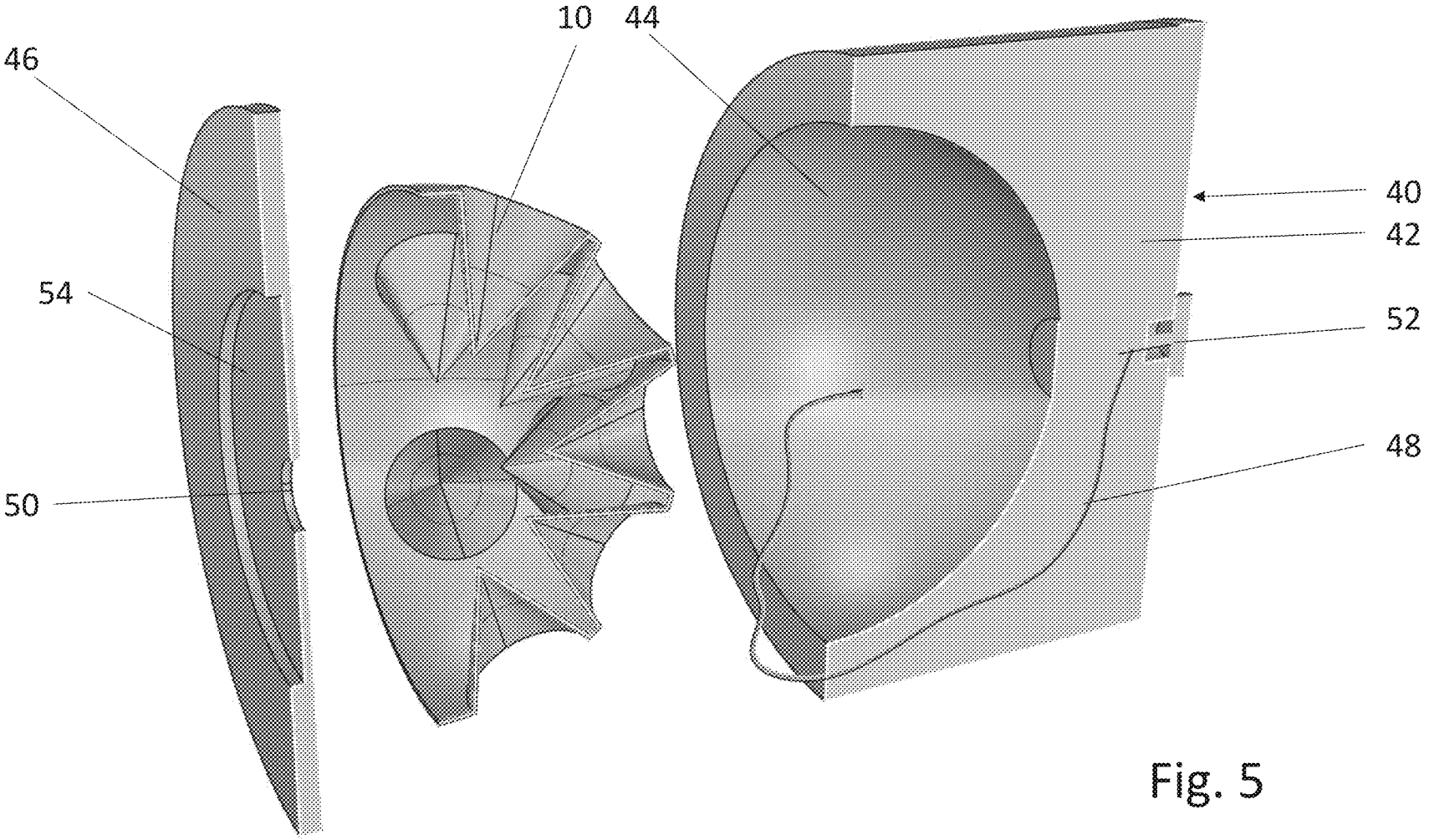
FIG. 5 is an exploded diagram of a variant of the propellant mechanism of FIG. 1.

Reference is now made to FIG. 5, which is a simplified diagram showing the casing 40 as before. In front plate 46 the central region around hole 50 the thickness of the plate is reduced. The thinner part breaks preferentially over the rest of the plate on detonation, further focusing the blast towards the central axis of the projectile.

Figure 6:
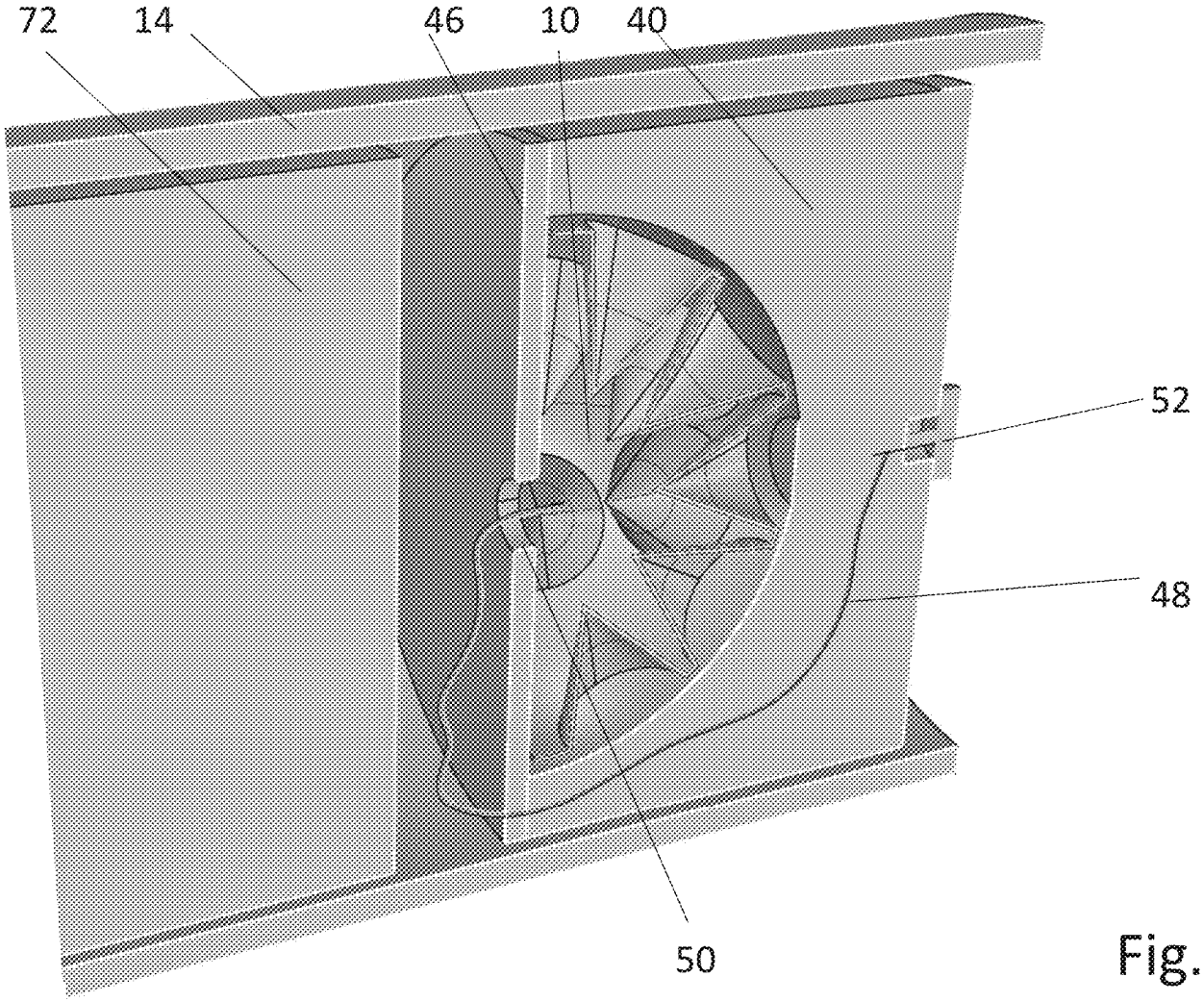
FIG. 6 is a simplified diagram showing a variant in which the propellant mechanism and the casing form the projectile itself, according to a further embodiment of the present invention.

Reference is now made to FIG. 6, which is a simplified diagram of a variation of the present embodiment in which the propellant and casing structure form the projectile itself and there is no separate projectile to be launched.

Figure 7:
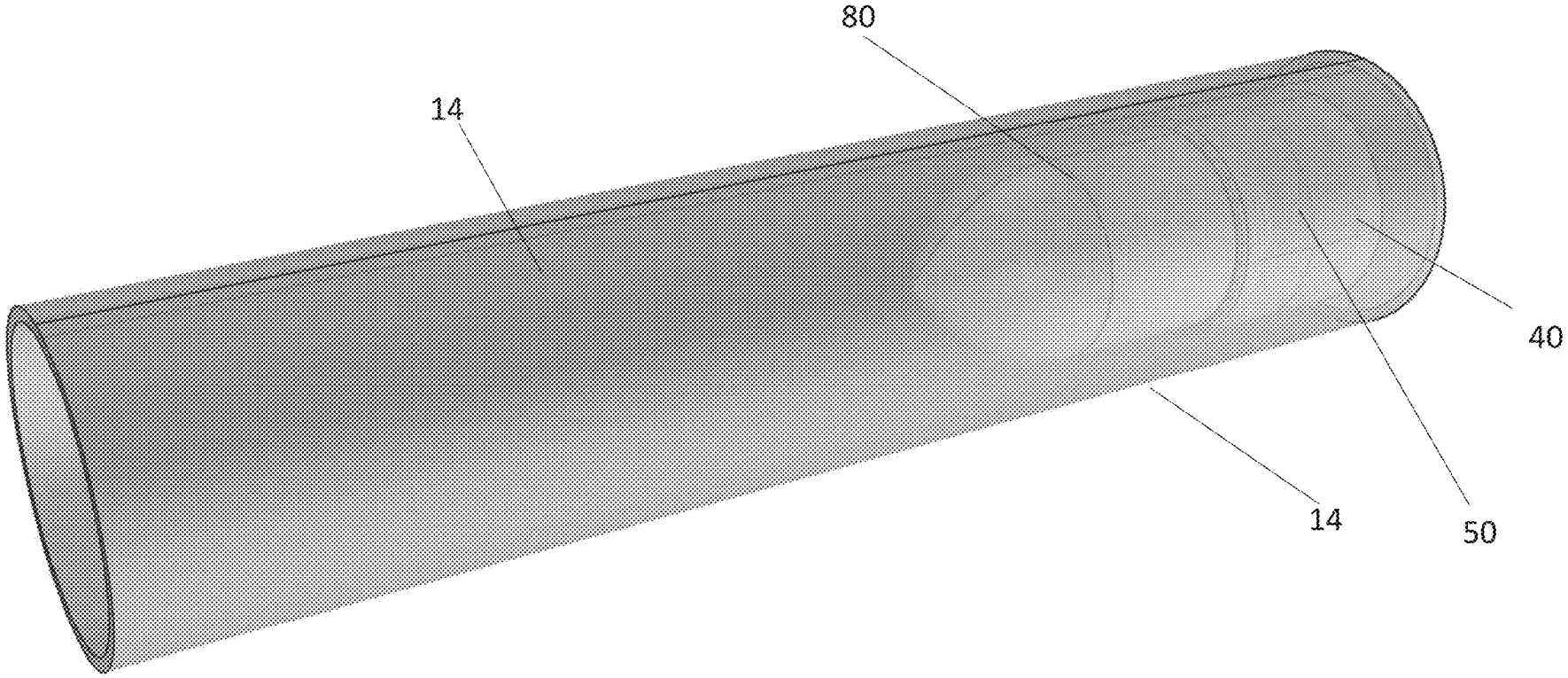
FIG. 7 is a simplified diagram showing a projectile with a propellant mechanism built into the barrel of a gun, according to an embodiment of the present invention.

A projectile with a built in propellant mechanism for launching the projectile is shown as 70 in FIG. 6. As before the structure includes the shape-charge propellant mechanism 10 and the casing 40. In this case the gun tube 14 includes a fixed mass 72 on the propellant side of the combined projectile 70. The propellant is detonated as before from the flat side of the propellant and the detonation wave advances towards the parabolic surface 44, from which it is reflected and it proceeds back until it hits the surface of mass 72. The result is that casing 40 is ejected at high speed from the gun. The casing may optionally include a payload such as a warhead (not shown). In the embodiment of FIG. 7 the triggering mechanism 52 may be located as shown or may be at the front or the side of the combined projectile 70.

The remaining parts are as in FIGS. 1-5.

FIG. 7 is a semi-transparent view of a projectile 80 according to any of FIGS. 1 to 7 within the barrel 14 of a gun and ready to be fired. The gun may be a single use gun and the casing 40 may be built into the barrel. Such a gun may be used for launching projectile 80 into orbit.

Figure 8:
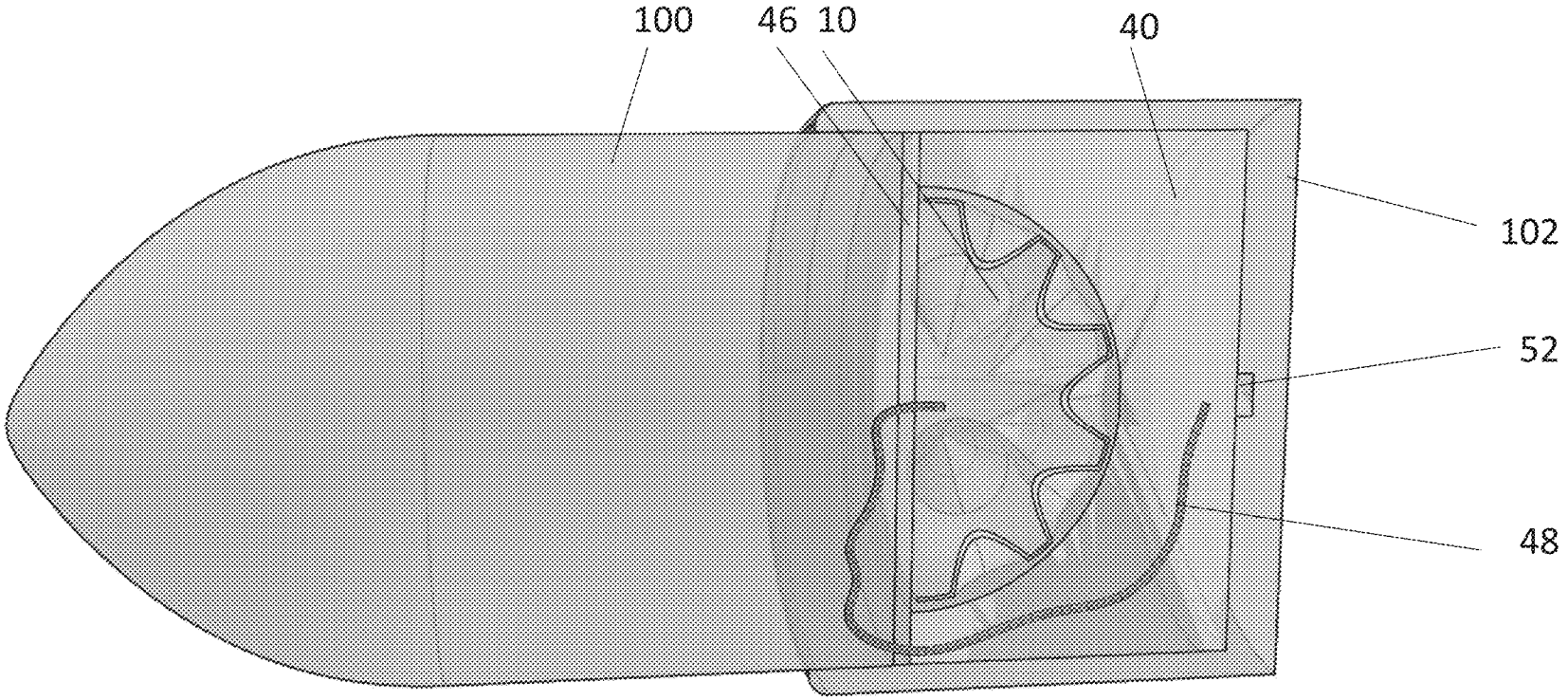
FIGS. 8 and 9 are two simplified diagrams showing combined projectiles with propellant mechanisms according to the present embodiments, wherein one has a front plate between the propellant and the projectile and one does not.
Figure 9:
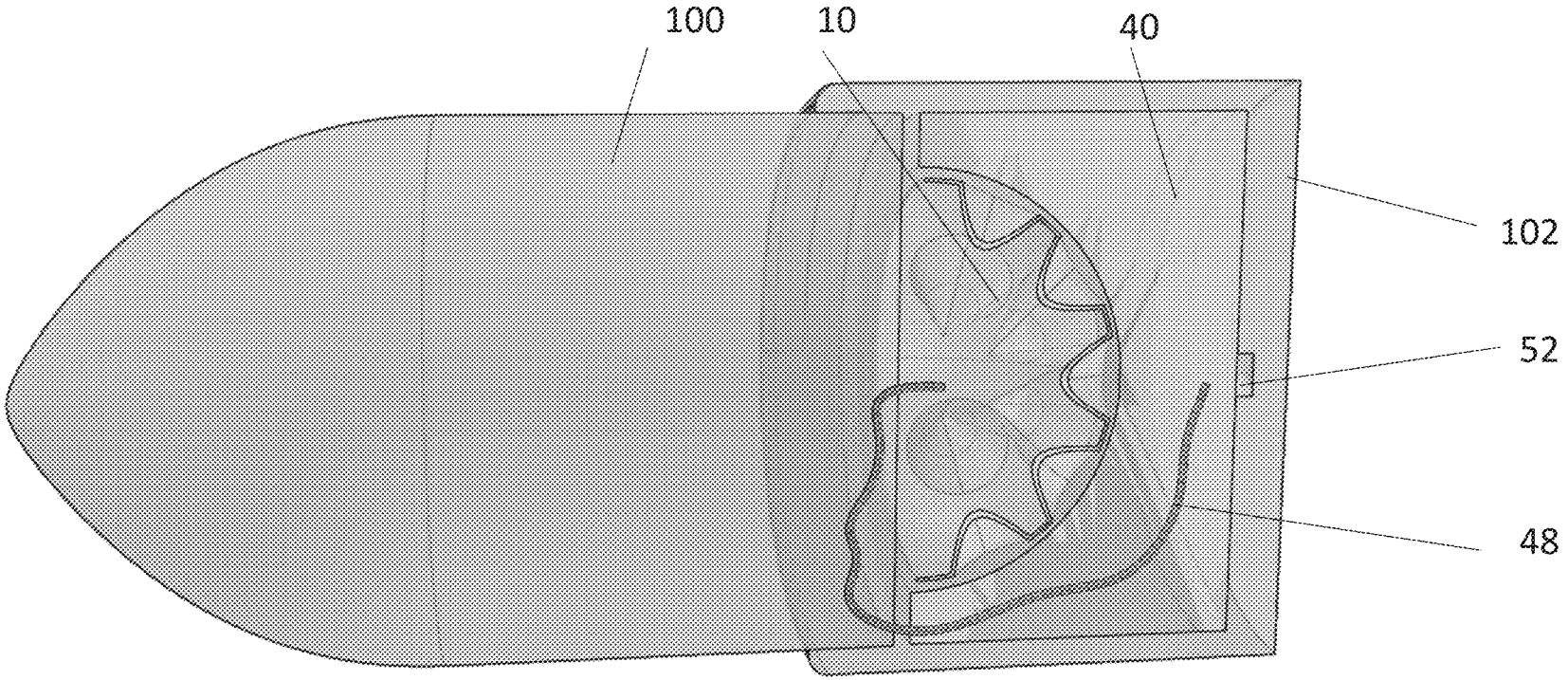

Reference is now made to FIGS. 8 and 9 which show a variation of the projectile of FIG. 1 in which the propellant casing 40, not to be confused with shell casing 102, is built in to the body of the projectile 100. In FIG. 8 a front plate 46 is included and in FIG. 9 there is no front plate.

As mentioned, the projectile may include a warhead (not shown) and variations may include multiple warheads, or projectile parts or fragments or bomblets.

Figure 10:
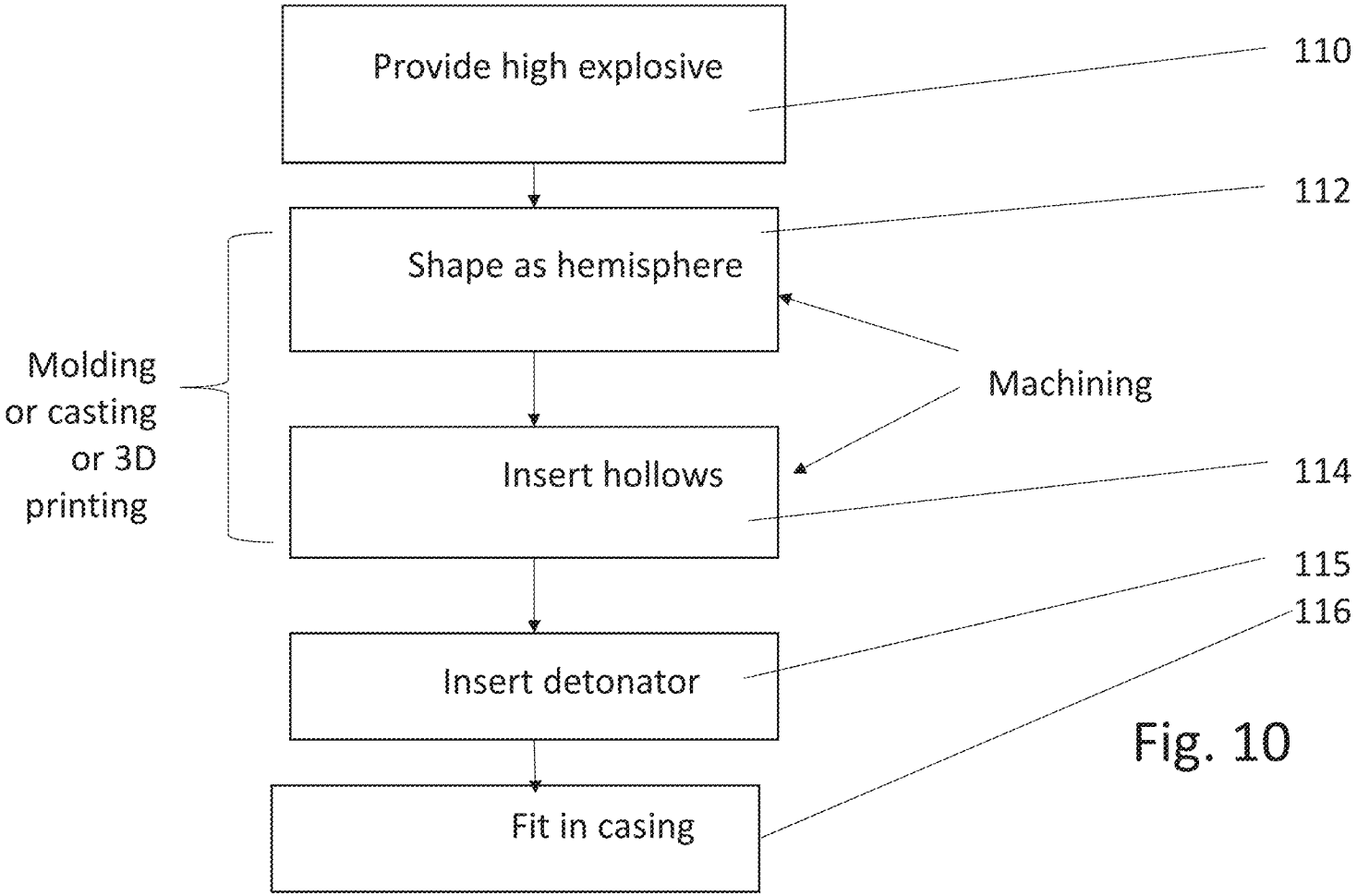
FIG. 10 is a simplified flow chart showing a method for manufacturing a shape charge propellant according to embodiments of the present invention.

Reference is now made to FIG. 10, which is a simplified flow chart illustrating a method of manufacturing a propellant mechanism according to the present embodiments for launching a projectile. In box 110 high explosive is obtained. In box 112 the high explosive is shaped into a hemispherical shape having a first rounded surface and a second flat surface. In box 114, hollow inserts are shaped into the first rounded surface.

A detonator may then be placed at the flat surface—box 115, and in box 116 the shaped high explosive is placed in the casing to provide the detonator mechanism. It is noted that detonation be direct, or may be via a secondary explosive.

Shaping the high explosive and then shaping the hollow inserts may involve a single casting or molding process, or the hemisphere may be cast or molded and the inserts may then be produced by machining. Alternatively the hemisphere may be produced by machining and the inserts may also be produced by machining.

In a variation of the manufacturing process, 3D printing or additive manufacture may be used to provide layerwise production of the shape charge. In this case, if inkjet methods are used, the temperature within the inkjet nozzles may be controlled so as not to reach the detonation temperature of the explosive. The nozzle itself may be temperature controlled so that the explosive droplets do not solidify and coagulate the jet. In addition, at preset times or after a predetermined amount of printing, the nozzle is cleared, say be a jet of air, so that explosive residue does not get a chance to line the nozzle. Likewise the printing area may be surrounded by a shield so that explosive residue is confined within the printing area.

As well as for making the shape charge of the present embodiments, the 3D printing of the present embodiments may be used for any case where a specific geometry of explosive is needed.

Figure 11:
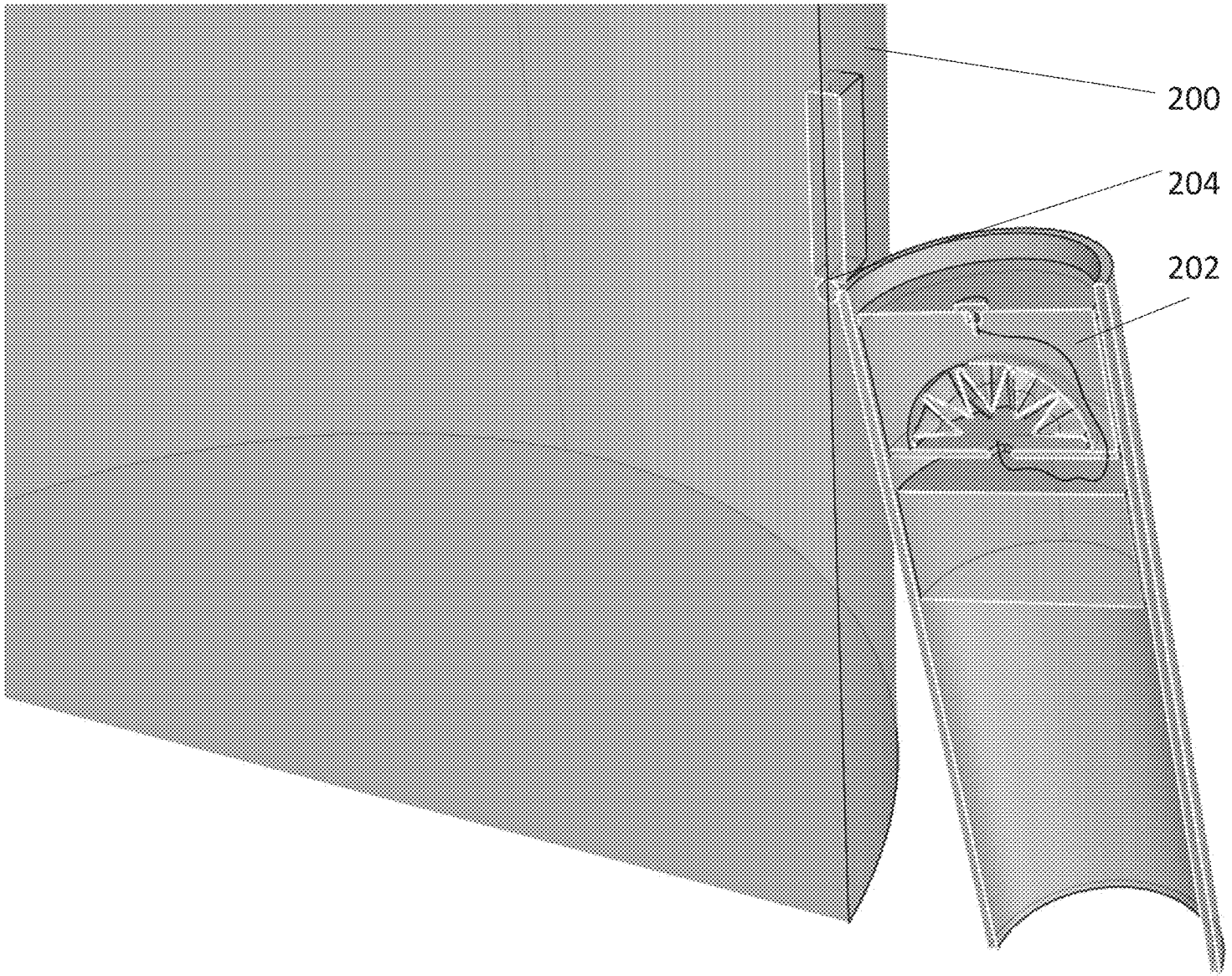
FIGS. 11, 12A and 12B are three figures showing how the propellant mechanism may be added as side elements to a projectile according to embodiments of the present invention.
Figure 12A:
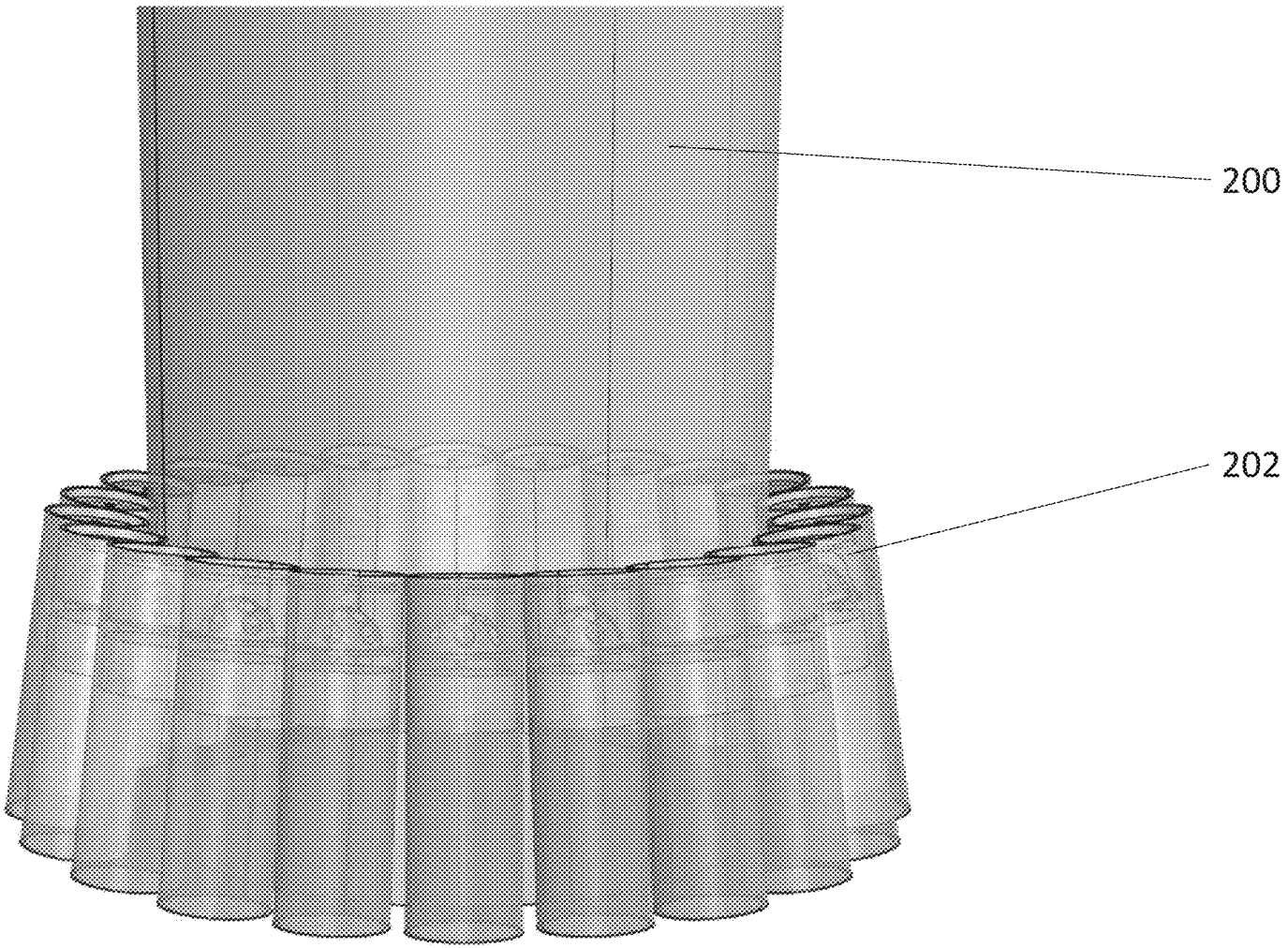
Figure 12B:
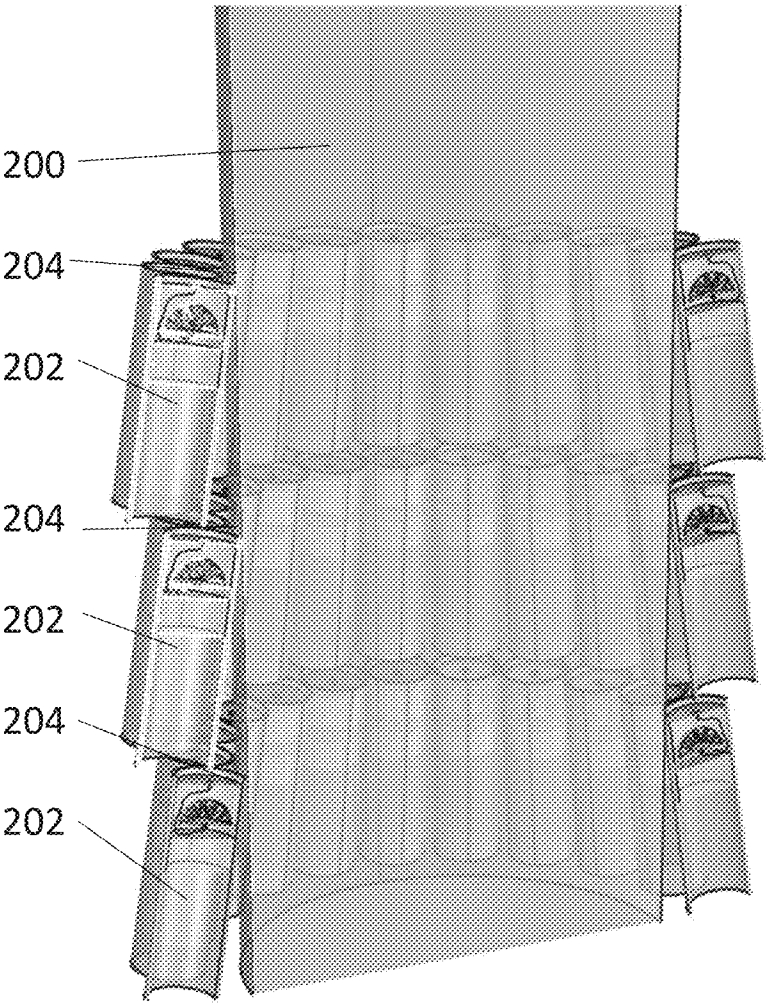

Reference is now made to FIGS. 11 and 12A and 12B, which show a projectile 200 with propellant mechanisms 202 according to the present embodiments fixed around the side. The propellant mechanisms may be fixed to the projectile via hinges 204. The ability to tilt the mechanisms may serve two purposes. First of all tilting some of the mechanisms and not others may allow for directionality. Secondly, tilting all of the mechanisms in the same way may vary the total power and thus reduce deformation.

Wax support structures may be used to enable complex geometries, as is known in the art of additive manufacture.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment and the present description is to be construed as if such embodiments are explicitly set forth herein. Conversely, various features of the invention, which are, for brevity, described in the context of a single embodiment, may also be provided separately or in any suitable subcombination or may be suitable as a modification for any other described embodiment of the invention and the present description is to be construed as if such separate embodiments, subcombinations and modified embodiments are explicitly set forth herein. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A propellant mechanism for launching a projectile comprising:

a casing, the casing having a body and a hollow in said body;

a forward direction and a first end of said casing towards said projectile and a backwards direction and a second end of said casing away from said projectile;

a propellant with a detonation point, the detonation point comprising a detonator, at which detonation point said propellant is initially detonated which is at said first end in said forward direction closest to said projectile, such that the detonation proceeds through the propellant in the backwards direction away from said projectile; and a reflecting surface mounted in said hollow towards said second end of said casing away from said projectile for reflecting said detonation into said forward direction towards said projectile, wherein said reflecting surface comprises a plurality of cavities, said cavities pointing towards said detonation point.

2. The propellant mechanism of claim 1, wherein said reflecting surface is shaped to focus said detonation towards said projectile.

3. The propellant mechanism of claim 2, wherein said plurality of cavities are configured in one of a predefined plurality of cavity configurations.

4. The propellant mechanism of claim 3, wherein the cavities are lined with one member of the group consisting of a structural material and a filler material.

5. The propellant mechanism of claim 1, wherein the cavities are cones, each having an apex and a longitudinal axis extending through said apex, said longitudinal axes extending through respective apexes of the cones and meeting at said detonation point.

6. The propellant mechanism of claim 1, wherein said casing is configured to cause preferential pressure discharge in the forward direction.

7. The propellant mechanism of claim 6, wherein said casing comprises a plate on a side towards said projectile, or wherein said casing is attached to said projectile, or wherein said casing is detached from said projectile.

8. A projectile with a propellant mechanism for launching the projectile, the projectile and propellant mechanism comprising:

a casing, the casing having a body and a hollow in said body;

a forward direction and a first end of said casing in a launch direction and a backwards direction and a second end of said casing away from said launch direction;

a propellant with a detonation point, the detonation point comprising a detonator, at which detonation point said propellant is initially detonated, said detonation point being at said first end, such that the detonation proceeds through the propellant in the backwards direction away from said projectile; and a reflecting surface mounted in said hollow towards said second end of said casing away from said projectile for reflecting said detonation into said forward direction towards said projectile, wherein said reflecting surface comprises a plurality of cavities, said cavities pointing towards said detonation point.

9. The projectile and propellant mechanism of claim 8, wherein said reflecting surface is shaped to focus said detonation towards said projectile.

10. The projectile and propellant mechanism of claim 9, wherein said cavities are configured in one of a predefined plurality of cavity configurations.

11. The projectile and propellant mechanism of claim 10, wherein the cavities are lined with a structural material.

12. The projectile and propellant mechanism of claim 10, wherein the cavities are filled with a filler material.

13. The projectile and propellant mechanism of claim 9, comprising a plurality of separable projectile parts within said casing.

14. The projectile and propellant mechanism of claim 8, wherein the cavities are cones, each having an apex and a longitudinal axis extending through said apex, said longitudinal axes extending through respective apexes of the cones and meeting at said detonation point.

15. The projectile and propellant mechanism of claim 8, wherein said casing comprises a plate on a side of said propellant mechanism towards said projectile.

16. The projectile and propellant mechanism of claim 8, wherein the cavities are non-uniform.

17. The projectile and propellant mechanism of claim 16, wherein at least some of said cavities have a lengthwise axis towards an apex wherein said lengthwise axis towards said apex does not point to said detonation point.

* * * * *